US005638980A

United States Patent [19]

Parks

[11] Patent Number: 5,638,980

[45] Date of Patent: Jun. 17, 1997

[54] FLUID STORAGE SAFETY DEVICE

[76] Inventor: Joseph R. Parks, 3374 Dawson St., Pittsburgh, Pa. 15213

[21] Appl. No.: 536,629

[22] Filed: Sep. 29, 1995

[51] Int. Cl.[6] ..... B65D 8/00; B65D 8/22; B65D 88/12; B65D 90/36

[52] U.S. Cl. ..... 220/562; 220/4.12; 220/89.1; 220/612; 220/623

[58] Field of Search ..... 220/562, 563, 220/565, 612, 623, 624, 4.12, 659, 89.1, 89.2

[56] References Cited

U.S. PATENT DOCUMENTS

| | | | |
|---|---|---|---|
| 614,892 | 11/1898 | Reynolds | 220/623 X |
| 920,729 | 5/1909 | Cooper | 220/89.2 |
| 1,336,439 | 4/1920 | Ostrander | 220/562 |
| 2,146,960 | 2/1939 | Kuss | 220/562 X |
| 2,363,980 | 11/1944 | Lauck | 220/612 |
| 2,613,015 | 10/1952 | Keating | 220/612 X |
| 3,128,903 | 4/1964 | Crisci | 220/659 X |
| 3,366,263 | 1/1968 | Murdock | 220/4.12 |
| 3,788,514 | 1/1974 | Giacoma, Jr. et al. | 220/89.1 |
| 4,385,710 | 5/1983 | Kurihara et al. | 220/89.2 |
| 5,303,843 | 4/1994 | Zink et al. | 220/89.2 X |

*Primary Examiner*—Allan N. Shoap
*Assistant Examiner*—Niki M. Kopsidas

[57] ABSTRACT

A fluid storage safety device comprised of a pair of end portions. Each of the end portions has a concave end and a convex end. The convex end has an outer periphery. The outer periphery has a series of alternating abutted and recessed portions disposed thereon. The pair of end portions are adapted to be received within open end portions of a storage tank with the outer periphery of the convex end aligned with a peripheral outer edge of the open end portions of the storage tank. The pair of end portions are secured within the open end portions by welds at the meeting point of the outer periphery of the convex end and the peripheral outer edge of the open end portions of the storage tank.

1 Claim, 3 Drawing Sheets

FLUID STORAGE SAFETY DEVICE

BACKGROUND OF THE INVENTION

1. Field of the Invention

The present invention relates to a fluid storage safety device and more particularly pertains to resisting pressure explosions which can hurl storage tank ends with a fluid storage safety device.

2. Description of the Prior Art

The use of explosion resistant devices is known in the prior art. More specifically, explosion resistant devices heretofore devised and utilized for the purpose of resisting explosions are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,299,709 to Beerbower et al. discloses an above ground fuel storage tank.

U.S. Pat. No. 5,251,473 to Reese discloses a method and storage tank system for aboveground storage of flammable liquids.

U.S. Pat. No. 4,925,053 to Fenton et al. discloses a fuel tank vaporization and explosion resistant apparatus and improved filler mass.

U.S. Pat. No. 4,673,098 to Fenton et al. discloses a fuel tank vaporization and explosion resistant apparatus.

U.S. Pat. No. 4,615,455 to Tansill discloses an explosion-resistant fuel tank device.

While these devices fulfill their respective, particular objective and requirements, the aforementioned patents do not describe a fluid storage safety device for resisting pressure explosions which can hurl storage tank ends.

In this respect, the fluid storage safety device according to the present invention substantially departs from the conventional concepts and designs of the prior art, and in doing so provides an apparatus primarily developed for the purpose of resisting pressure explosions which can hurl storage tank ends.

Therefore, it can be appreciated that there exists a continuing need for new and improved fluid storage safety device which can be used for resisting pressure explosions which can hurl storage tank ends. In this regard, the present invention substantially fulfills this need.

SUMMARY OF THE INVENTION

In the view of the foregoing disadvantages inherent in the known types of explosion resistant devices now present in the prior art, the present invention provides an improved fluid storage safety device. As such, the general purpose of the present invention, which will be described subsequently in greater detail, is to provide a new and improved fluid storage safety device and method which has all the advantages of the prior art and none of the disadvantages.

To attain this, the present invention essentially comprises a tank having open end portions. The tank is adapted to hold liquids such as oil, gasoline, and milk. The tank has filling holes and vents formed through an upper surface thereof. The device contains a pair of end portions. Each of the end portions has a concave end or side and a convex end or side. The convex end has an outer periphery. The outer periphery has a series of alternating abutted and recessed portions disposed thereon. The pair of end portions are adapted to be received within the open end portions of the tank with the outer periphery of the convex end aligned with a peripheral outer edge of the open end portions of the tank. The pair of end portions are secured within the open end portions by welds at the meeting point of the outer periphery of the convex end and the peripheral outer edge of the open end portions of the tank.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved fluid storage safety device which has all the advantages of the prior art explosion resistant devices and none of the disadvantages.

It is another object of the present invention to provide a new and improved fluid storage safety device which may be easily and efficiently manufactured and marketed.

It is a further object of the present invention to provide a new and improved fluid storage safety device which is of durable and reliable construction.

An even further object of the present invention is to provide a new and improved fluid storage safety device which is susceptible of a low cost of manufacture with regard to both materials and labor, and which accordingly is then susceptible of low prices of sale to the consuming public, thereby making such a fluid storage safety device economically available to the buying public.

Still yet another object of the present invention is to provide a new and improved fluid storage safety device which provides in the apparatuses and methods of the prior art some of the advantages thereof, while simultaneously overcoming some of the disadvantages normally associated therewith.

Even still another object of the present invention is to provide a new and improved fluid storage safety device for resisting pressure explosions which can hurl storage tank ends.

Lastly, it is an object of the present invention to provide a new and improved fluid storage safety device comprised of a pair of end portions. Each of the end portions has a concave end and a convex end. The convex end has an outer periphery. The outer periphery has a series of alternating abutted and recessed portions disposed thereon. The pair of end portions are adapted to be received within open end portions of a storage tank with the outer periphery of the convex end aligned with a peripheral outer edge of the open end portions of the storage tank. The pair of end portions are secured within the open end portions by welds at the meeting point of the outer periphery of the convex end and the peripheral outer edge of the open end portions of the storage tank. Weak welds around the circumferences of the tank cause the ends to fall before there is a rupture in any other part of the tank.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
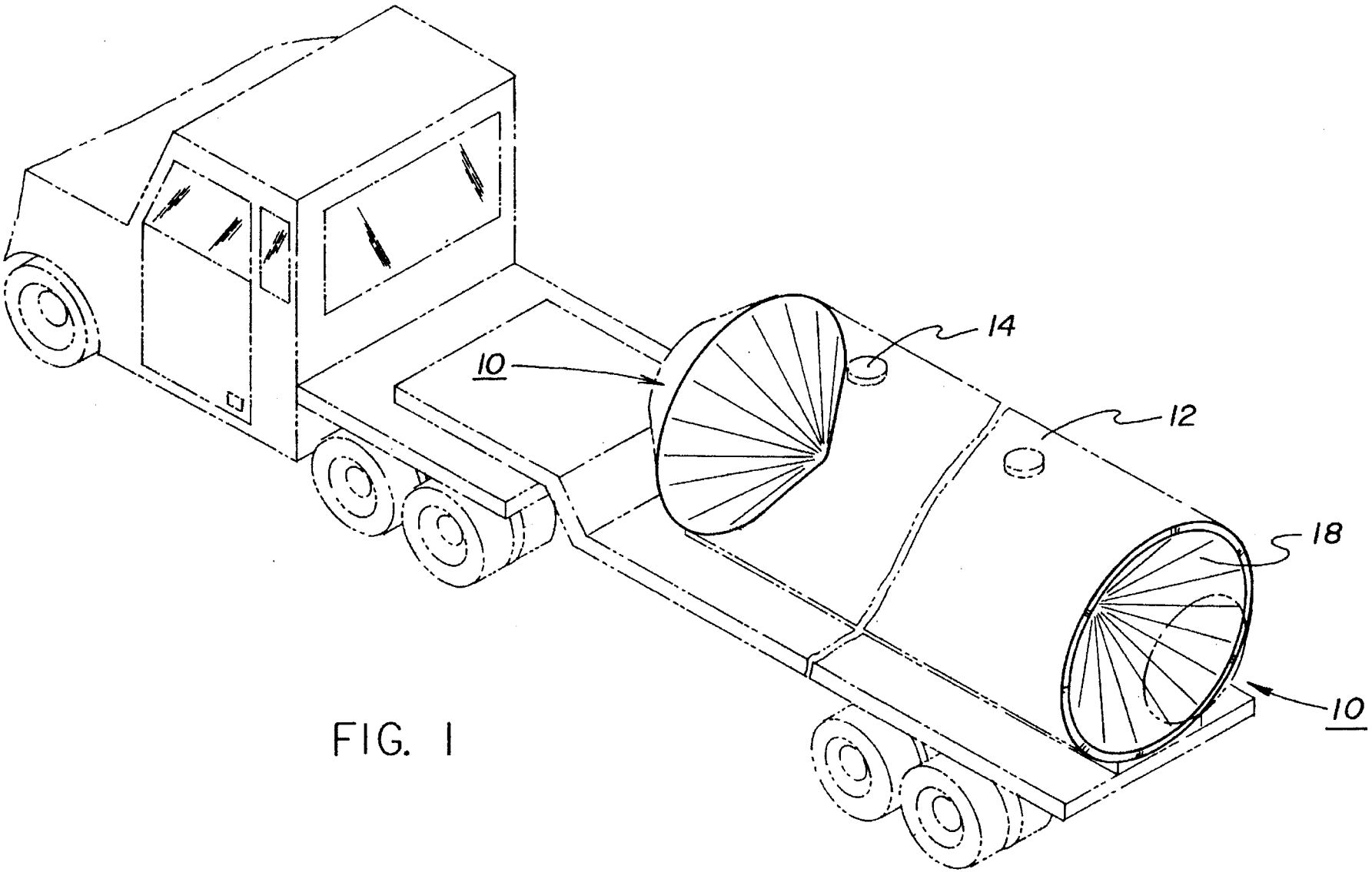
FIG. 1 is a perspective view of the preferred embodiment of the fluid storage safety device constructed in accordance with the principles of the present invention.
Figure 2:
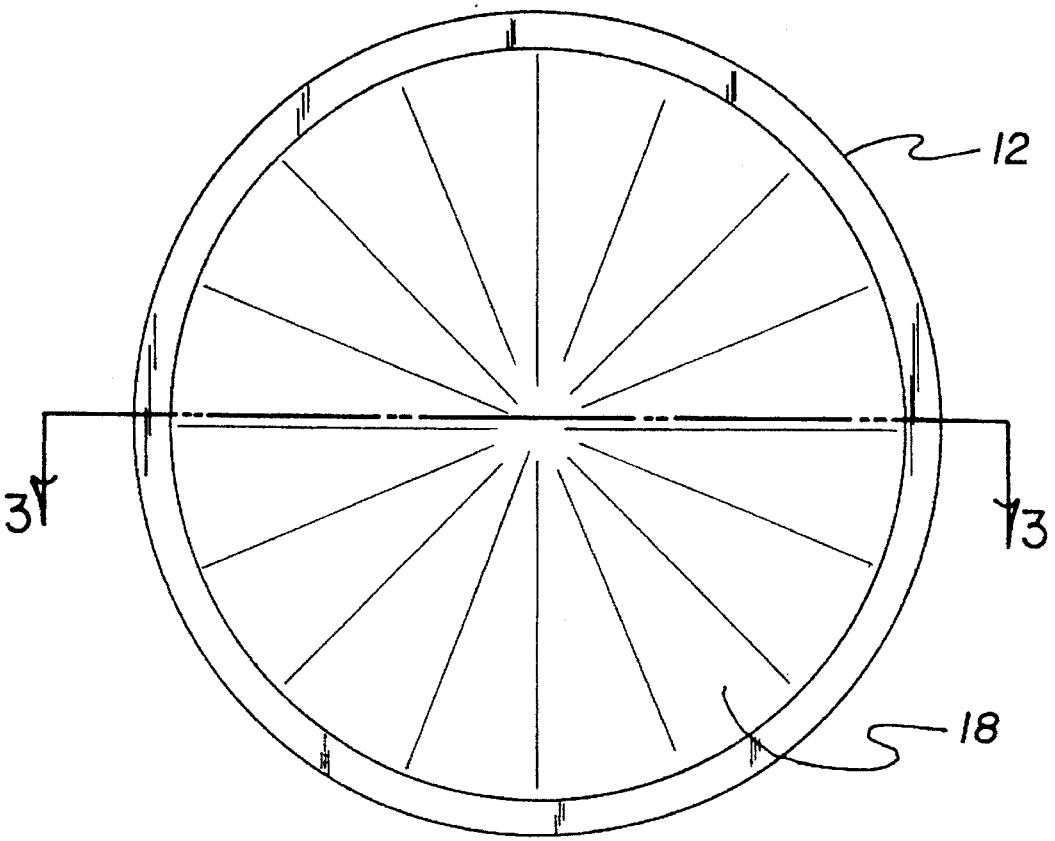
FIG. 2 is a front elevation view of the present invention.
Figure 3:
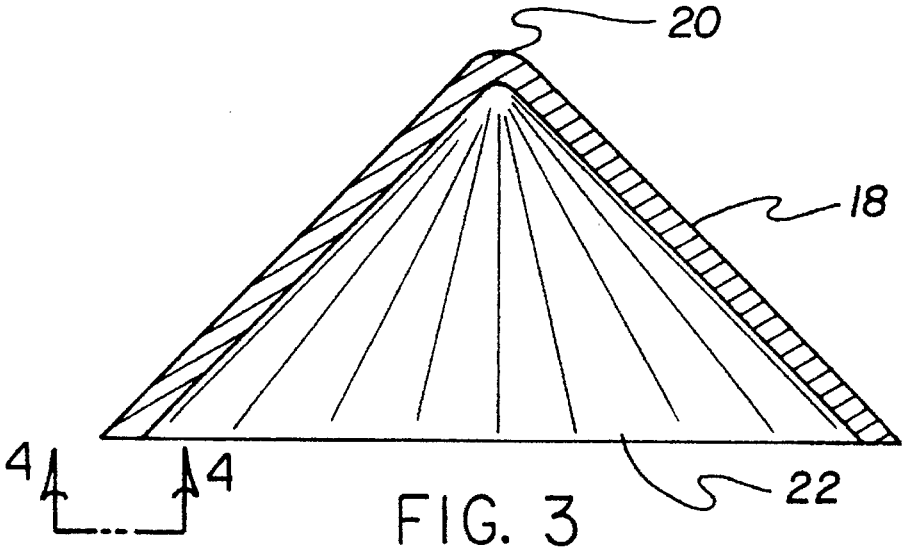
FIG. 3 is a cross-sectional view as taken along line 3—3 of FIG. 2.
Figure 4:
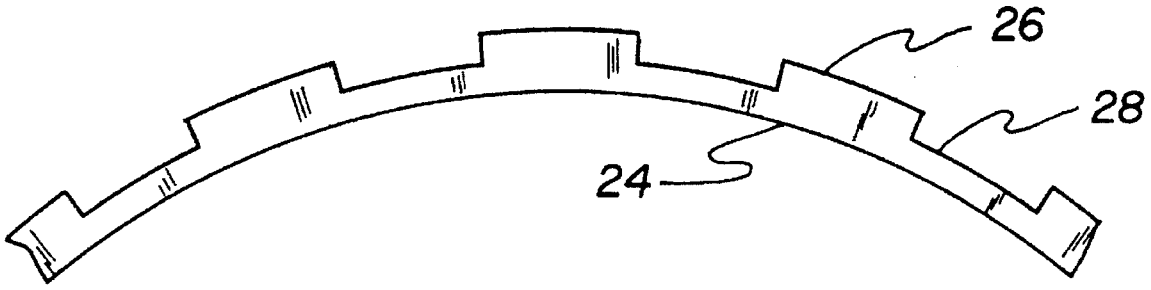
FIG. 4 is a cross-sectional view as taken along line 4—4 of FIG. 3.
Figure 5:
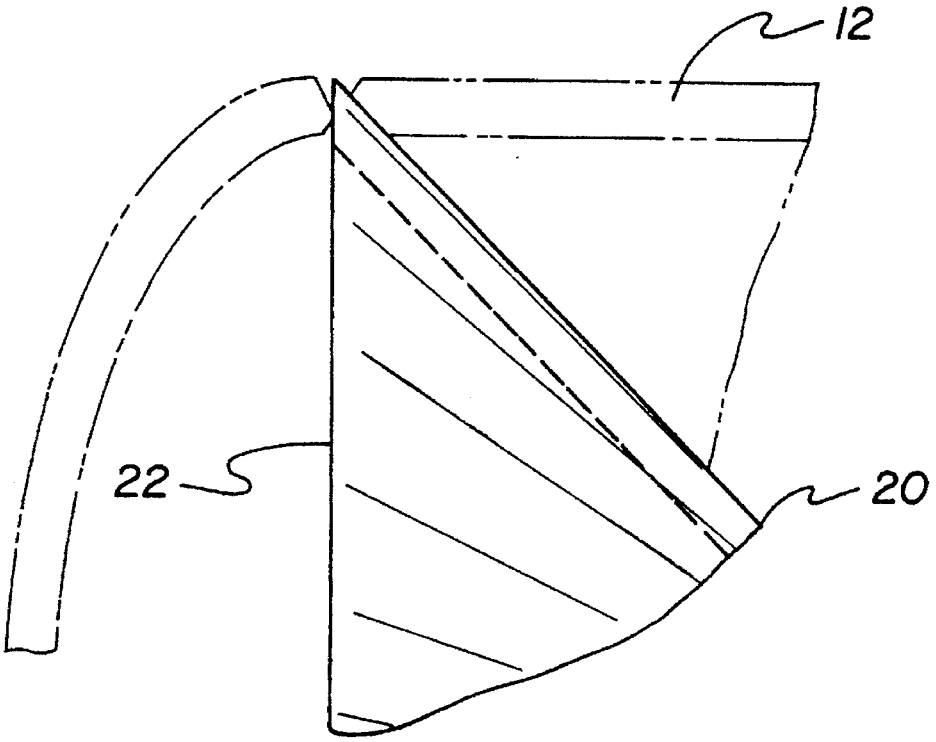
FIG. 5 is a partial side view of the convex end of the present invention.

With reference now to the drawings, and in particular, to FIGS. 1–5 thereof, the preferred embodiment of the new and improved fluid storage safety device embodying the principles and concepts of the present invention and generally designated by the reference number 10 will be described.

Specifically, it will be noted in the various Figures that the device relates to a new and improved fluid storage safety device for resisting pressure explosions which can hurl storage tank ends. In its broadest context, the device consists of a tank and a pair of end portions. Such components are individually configured and correlated with respect to each other so as to attain the desired objectives.

The device 10 contains a tank 12 having open end portions. The tank 12 is adapted to hold any type of fluid, gas or liquid such as oil, gasoline and milk. The tank 12 has filling holes 14 and vents formed through an upper surface thereof.

The device 10 contains a pair of end portions 18. Each of the end portions 18 has a convex end 20 and a concave end 22. The concave end 22 has an outer periphery 24. The outer periphery 24 has a series of alternating abutted 26 and recessed 28 portions disposed thereon. The pair of end portions 18 are adapted to be received within the open end portions of the tank 12 with the outer periphery 24 of the convex end 20 aligned with a peripheral outer edge of the open end portions of the tank 12. The pair of end portions 18 are secured within the open end portions by welds at the meeting point of the outer periphery 24 of the convex end 20 and the peripheral outer edge of the open end portions of the tank 12.

The present invention is a fluid storage safety device 10 that resists pressure explosions which can hurl storage tank ends at firefighters or other people nearby.

A change in the interior design of the tank 12 directs the pressure of an explosive blast around the circumference of the end of the tank 12. A typical tank 12 for storing fluids such as oil, gasoline, or even milk has a welded convex end 20. This new system provides a tank 12 the same shape and size as previous tanks (with filler caps and air vents) except the weld around the outer periphery 24 of each convex end 20 would be weaker than others in the tank 12. Inside the tank 12, each end is fitted with a convex end 20 whose point is directed toward the center of the tank 12.

When a fluid storage tank 12 is exposed to the high heat of a fire, the liquid boils, creating tremendous pressure inside the tank 12. Eventually the pressure buildup blows the ends off the tank 12, making them deadly projectiles which cause property damage and injuries. This tank 12 design diverts the pressure of the blast around the outer periphery 24 of the interior convex end 20. The weak weld around the outer periphery 24 gives way, so that the pressure of the blast is directed around the edges of the convex end 20, instead of the center.

Fluid storage tanks 12 with this design should prevent injuries to anyone. It may also help to prevent property damage.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the U.S. is as follows:

1. A fluid storage safety device for preventing pressure explosions which can hurl storage tank ends comprising, in combination:

a tank having open end portions, the tank being able to hold oil, gasoline, and milk, the tank having filling holes and vents formed through an upper surface thereof;

a pair of end portions, each of the end portions having a concave side and a convex side, the convex side having an outer periphery, the outer periphery having a series of alternating abutted and recessed portions disposed thereon, the pair of end portions being receivable within the open end portions of the tank with the outer periphery of the convex side adjacent to a peripheral outer edge of the open end portions of the tank, the pair of end portions being secured within the open end portions by welds within the recessed portions of the outer periphery of the convex side and the peripheral outer edge of the open end portions of the tank, the welds forming a circumferential stress relief point whereby a pressure build-up within the tank will cause the welds to give thereby eliminating dangerous protection of the pair of end portions.

* * * * *